US008556754B2

(12) United States Patent
Roman

(10) Patent No.: US 8,556,754 B2
(45) Date of Patent: Oct. 15, 2013

(54) LEG STRAPS WITH HORIZONTAL HANDLES

(76) Inventor: Kendyl Allen Roman, Sunnyvale, CA (US)

( * ) Notice: Subject to any disclaimer, the term of this patent is extended or adjusted under 35 U.S.C. 154(b) by 251 days.

(21) Appl. No.: 11/899,530

(22) Filed: Sep. 6, 2007

(65) Prior Publication Data

US 2009/0069121 A1 Mar. 12, 2009

(51) Int. Cl.
*A63B 69/00* (2006.01)

(52) U.S. Cl.
USPC ..... 473/438; 473/450; 473/458

(58) Field of Classification Search
USPC ..... 473/438, 205, 206, 212, 213, 214, 450, 473/458; 128/845, 878; 2/24, 12, 16, 170, 2/22, 303.311, 322; 601/45; D21/662; 602/19, 21, 26, 60; D24/190; D3/221; D8/321; 224/222, 673; 36/10; 383/18
See application file for complete search history.

(56) References Cited

U.S. PATENT DOCUMENTS

| | | | | | |
|---|---|---|---|---|---|
| 1,153,377 | A | * | 9/1915 | Fourt | 383/15 |
| 1,477,424 | A | * | 12/1923 | Callan | 2/303 |
| 1,589,677 | A | * | 6/1926 | Bisch | 2/320 |
| 1,697,270 | A | * | 1/1929 | Fischer | 2/240 |
| 1,903,081 | A | * | 3/1933 | Wotherspoon | 224/223 |
| 2,241,833 | A | * | 5/1941 | Waller | 482/105 |
| 2,380,272 | A | * | 7/1945 | Sutter | 450/106 |
| 2,552,177 | A | * | 5/1951 | Hurt | 2/24 |
| 2,661,888 | A | * | 12/1953 | Sidlinger | 182/3 |
| 2,905,948 | A | * | 9/1959 | Grisanti | 2/237 |
| 3,487,474 | A | * | 1/1970 | De Meo | 2/311 |
| 3,640,273 | A | * | 2/1972 | Ray | 602/5 |
| 3,786,804 | A | * | 1/1974 | Lewis | 602/16 |
| 3,859,667 | A | * | 1/1975 | Roy | 2/212 |
| 3,870,317 | A | * | 3/1975 | Wilson | 473/216 |
| 3,940,801 | A | * | 3/1976 | Riggs et al. | 2/311 |
| 3,970,081 | A | * | 7/1976 | Applegate, Jr. | 128/95.1 |
| 4,084,584 | A | * | 4/1978 | Detty | 602/26 |
| 4,239,228 | A | * | 12/1980 | Norman et al. | 473/212 |
| 4,370,978 | A | * | 2/1983 | Palumbo | 602/26 |

(Continued)

FOREIGN PATENT DOCUMENTS

| | | | |
|---|---|---|---|
| FR | 2754679 | A1 * | 4/1998 |
| GB | 2347067 | A * | 8/2000 |

OTHER PUBLICATIONS

Webpage Download—Debbie Colgrove, Darts in Clothing, 2007, http://sewing.about.com/od/techniques/ss/sewingdarts.htm, 9 pages.*

(Continued)

*Primary Examiner* — Gene Kim
*Assistant Examiner* — M Chambers

(57) ABSTRACT

A leg strap with preferably horizontal handles attached at each end of each handle, is used to aid in lifting a jumping player, especially for lineouts in Rugby Union. The handles are preferably made of elastic bands with contract to provide a tight fit on the leg of the jumper and when jumping allow for secure grasp by lifters. The simple, reusable, easy to use leg straps provide a level of effectiveness, comfort, convenience, and safety not provided by conventional methods. To use, leg straps are applied to one or more legs of a jumper. When the jumper jumps, one or more lifters grip the leg device. The lifters lift the jumper higher, support the jumper in the jump while the jumper attempts to intercept a ball, and safely lower the jumper.

17 Claims, 6 Drawing Sheets

(56) References Cited

U.S. PATENT DOCUMENTS

| | | | | | |
|---|---|---|---|---|---|
| 4,390,014 | A | * | 6/1983 | Forman | 602/19 |
| 4,396,013 | A | * | 8/1983 | Hasslinger | 128/845 |
| 4,476,857 | A | * | 10/1984 | Levine | 602/20 |
| 4,481,941 | A | * | 11/1984 | Rolfes | 602/19 |
| 4,484,361 | A | * | 11/1984 | Leighton et al. | 2/24 |
| 4,527,289 | A | * | 7/1985 | Shea | 2/322 |
| 4,532,921 | A | * | 8/1985 | von Torklus et al. | 602/26 |
| 4,632,106 | A | * | 12/1986 | Gamm | 602/63 |
| 4,782,535 | A | * | 11/1988 | Yewer et al. | 2/321 |
| 4,796,303 | A | * | 1/1989 | Atwater | 2/24 |
| 4,832,010 | A | * | 5/1989 | Lerman | 602/63 |
| 4,836,194 | A | * | 6/1989 | Sebastian et al. | 602/19 |
| 4,836,427 | A | * | 6/1989 | McManus | 224/684 |
| 4,949,957 | A | * | 8/1990 | Cucchiara | 482/93 |
| 5,069,457 | A | * | 12/1991 | Korzenowski | 473/214 |
| 5,076,288 | A | * | 12/1991 | Millard et al. | 128/869 |
| 5,147,261 | A | * | 9/1992 | Smith et al. | 482/106 |
| 5,152,443 | A | * | 10/1992 | Hagan | 224/662 |
| 5,168,576 | A | * | 12/1992 | Krent et al. | 2/456 |
| 5,413,262 | A | * | 5/1995 | Dewire et al. | 224/675 |
| 5,693,006 | A | * | 12/1997 | Slautterback | 602/19 |
| 5,718,189 | A | * | 2/1998 | Blake | 119/770 |
| 5,768,702 | A | * | 6/1998 | Kim | 2/1 |
| D416,651 | S | * | 11/1999 | Lanoue | D29/120.1 |
| 5,983,391 | A | | 11/1999 | Palmer et al. | |
| 6,105,163 | A | * | 8/2000 | Edmiston | 2/22 |
| 6,668,833 | B2 | * | 12/2003 | Rhee | 128/845 |
| 2002/0084295 | A1 | * | 7/2002 | Martindale et al. | 224/219 |
| 2004/0112303 | A1 | * | 6/2004 | Moulton, III | 119/795 |
| 2006/0085884 | A1 | * | 4/2006 | Giacheri | 2/24 |
| 2008/0102971 | A1 | * | 5/2008 | Anderson | 473/215 |
| 2009/0069121 | A1 | * | 3/2009 | Roman | 473/415 |

OTHER PUBLICATIONS

Web page download, Toolsforstagecraft, 1997, www.toolsforstagecraft.com/n323.htm, 5 pages.*

Translation of FR2-754-79-A1, 2005, 14 pages.*

European Search Report dated Dec. 29, 2011.

* cited by examiner

PRIOR ART

LEG STRAPS WITH HORIZONTAL HANDLES

BACKGROUND

1. Field of the Invention

This invention relates to a leg strap with handles used when lifting a person who is jumping or being lifted, for example a jumper in a Rugby lineout.

2. Description of Prior Art

There is a need to jump high in order to intercept a ball in many sports, such as Rugby, volleyball, or baseball.

For example, in Rugby Union, when a ball goes out of bounds it is returned to play using a set formation known as a lineout. In a lineout, players from both teams line up near where the ball went out of bounds. Each team forms its own line. A space of about one yard is formed between the lines of players, referred to as the tunnel. The ball is then thrown back into the playing field. The ball must be thrown straight into the middle of the tunnel. Players compete for the ball. A player has a greater likelihood of winning the ball if he is higher in the air than others. Therefore, players jump and/or are lifted up by teammates to be in a favorable position to win possession of the ball.

Other activities such as ice skating and dancing also involve lifts.

Various methods have been employed to accomplish these types of lifts and jumps.

Originally, players jumped unassisted by teammates, but the rules of Rugby Union have changed to allow teammates to support a player while in the air. At first, lifters would grab the waist of the jumper. It is currently illegal to grab on to or bind to the player while the player is on the ground. As time passed, it became common to support a jumping player by grabbing the player by the bottom of the shorts and lifting him/her by the shorts long enough to play the ball. More recently, it has been made legal to grab the jumping player by the thighs above the knee. Many jumping players wrap a combination of materials and tapes around the thigh to offer those lifting a better grip.

The use of such techniques has several disadvantages such as:

- Being ineffective, as a good grip is often still difficult to maintain
- Being unsafe, as jumping players that are dropped because of poor grip can fall up to 10 feet and land in an awkward position
- Damage to or tearing of clothing, especially if the proper shorts are not worn
- Extreme discomfort to the jumper
- Taking time to apply during the critical stages of pre-match preparation
- Requiring help to apply, as taping one's own leg is often difficult to do satisfactorily
- Needing to be taped before every game
- Requiring special skill of the lifter in the case where only one lifter is used It is also desirable to have a means for lifting that does not cause additional bunching and riding up of the short rugby shorts and that looks better than an awkward contraption of tapes on both thighs.

More recently, elastic sleeves with a gripping surface have also been placed around legs or knees. For example, U.S. patent application Ser. No. 11/499,023, filed Aug. 3, 2006, and U.S. patent application Ser. No. 11/800,356, filed May 4, 2007, disclose our earlier attempts to solve these problems. While successful in part, those earlier attempts still suffer from various problems.

Elastic leg sleeves have several disadvantages such as:

- Being constricting during the activity between lifts
- Being too elastic and sliding up during lifts
- Being hot, causing excessive sweating and odor
- Having material break down
- Being relatively heavy
- Expensive materials requiring expensive equipment to manufacture
- Having relative expensive materials
- Being complex, and thus costly to manufacture There is a need for a means to improve lifting in all levels of play, as ineffective lifts can be costly, dangerous, and contribute significantly to losing a game.

What is needed is an improved lightweight, low cost, easy to manufacture, quick, simple, easy to use, reusable device that provides an effective means of obtaining a sure grip that offers comfort and safety to the players involved.

Further, what is needed is a device that can be used by new players and youth to safely develop their technique, skill, and timing during practices and prior to game situations which may require conventional lifting aids.

SUMMARY OF THE INVENTION

Accordingly, it is an objective of the present invention to provide an improved lightweight, low cost, easy to manufacture, quick, easy to use, simple, reusable, effective means of lifting a jumper that provides safety and comfort to those involved.

OBJECTS AND ADVANTAGES

Accordingly, beside the objects and advantages described above, some additional objects and advantages of the present invention are:

1. To provide a comfortable method of lifting a player who is jumping.
2. To provide a more effective method of obtaining a sure grip on the thighs of a jumping player.
3. To provide an increase of safety for a jumping player being lifted by the thighs.
4. To provide means and methods of lifting that are easy to use.
5. To provide means and methods of lifting that are reusable.
6. To provide means and methods of lifting that offer higher performance.
7. To provide means and methods of lifting that can be quickly applied and removed.
8. To provide means and methods of lifting that are adjustable to varying conditions.
9. To empower a less skilled lifter to lift a jumper by himself.
10. To provide means and methods of lifting that are minimal in cost and waste.
11. To provide means and methods of lifting that do not worsen a user's appearance.
12. To provide means and methods of lifting that improve a user's appearance.
13. To provide means of lifting that do not stretch and slide up the jumper's leg during the lift.
14. To provide a youth and new player development device that can be safely used to teach technique, skill, and timing.

DRAWING FIGURES

In the drawings, closely related figures have the same number but different alphabetic suffixes.

REFERENCE NUMERALS IN DRAWINGS

| | |
|---|---|
| 10 (a-b) | horizontal handle |
| 11 | strap attachment |
| 12 | handle attachment |
| 14 | second strap attachment |
| 16 | second strap |
| 20 | dart |
| 22 | dart attachment |
| 40 | attachment loops |
| 50 (a-b) | attachment hooks |
| 80 | strap |
| 100 | leg strap with horizontal handles |
| 110 | first jumper |
| 112 | shorts |
| 120 | first lifter |
| 121 | left hand of first lifter |
| 122 | right hand of first lifter |
| 130 | second lifter |
| 131 | left hand of second lifter |
| 132 | right hand of second lifter |
| 140 | ball |
| 150 | second jumper |
| 154 | thigh |
| 160 | third lifter |
| 161 | left hand of third lifter |
| 162 | right hand of third lifter |
| 170 | fourth lifter |
| 171 | right hand of fourth lifter |
| 172 | left hand of forth lifter |
| 180 | third jumper |
| 190 | underwrap |
| 192 (a-b) | tape |
| 194 | bulge |
| 200 (a-d) | leg sleeve |
| 210 | semi-rigid grip |
| 220 | attachment |
| 230 | sleeve material |
| 990 | lower thigh |
| 992 | knee |
| 994 | calf |

Special Definitions non-elastic strap—a substantially linearly non-elastic, flat strip or ribbon of flexible material used for securing or holding together, e.g. polypropylene or cotton webbing elastic band—a substantially linearly elastic, flat strip of flexible material used for tightening, which has a predetermined limit to the amount of stretch before it becomes inelastic and provides tensile strength in its linear direction e.g. elastic waist band material

DESCRIPTION OF THE INVENTION

The present invention comprises an improved leg strap comprising a non-elastic strap with horizontal handles that are attached at both ends of the handle. When a person jumps, one or more other people can assist the jumper by gripping the means for gripping. Such a lifter is able to lift the jumper higher, support the jumper while in the air, and safely lower the jumper to the ground. When the jumper is not jumping, the jumper is able to run or otherwise move without hindrance or discomfort.

FIG. 1A

Figure 1A:
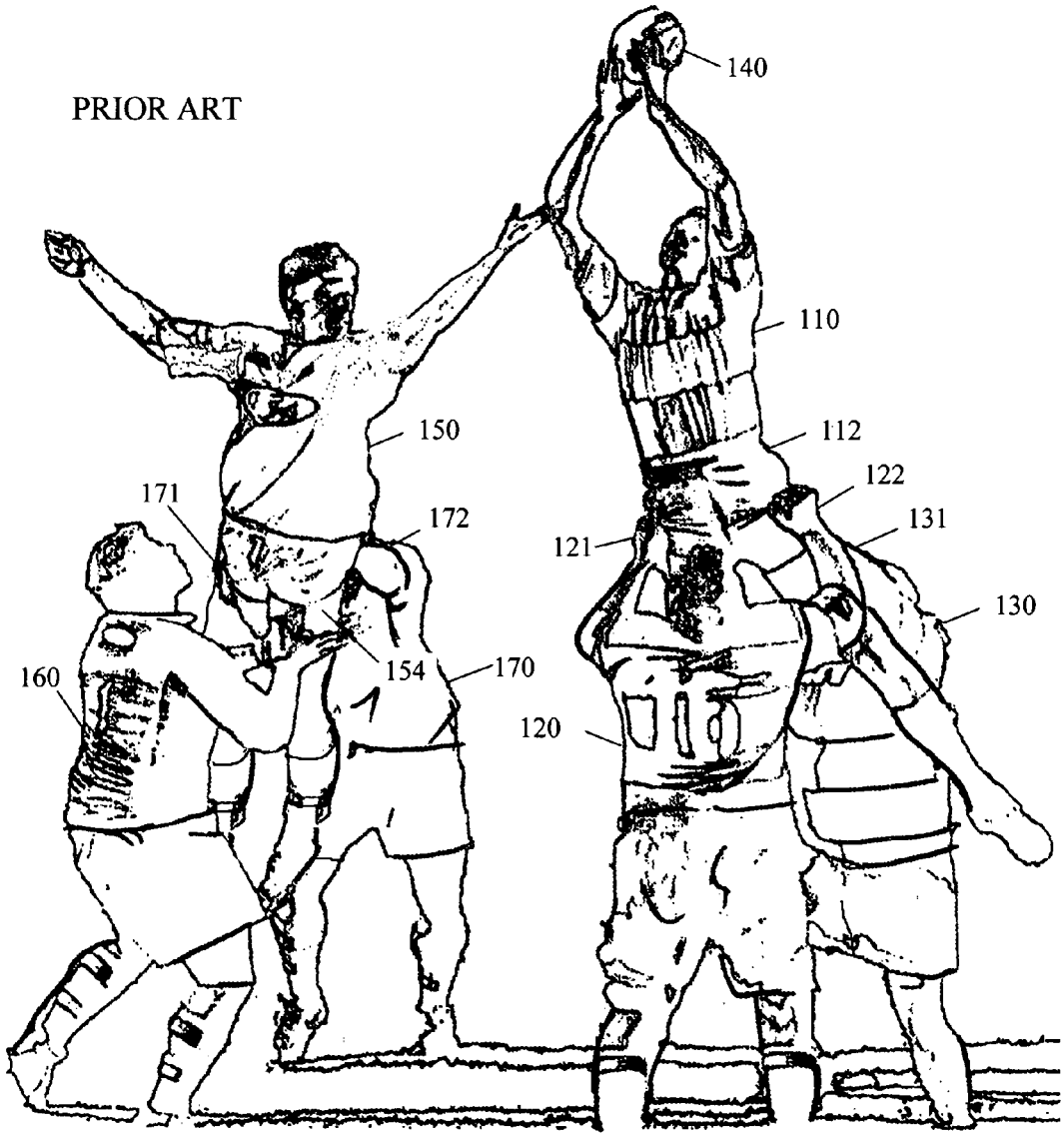
FIG. 1A and FIG. 1B show prior art techniques for lifting a jumper.

FIG. 1A illustrates two conventional means of lifting. As shown on the right, a first jumper 110 is lifted by a first lifter 120 and a second lifter 130. As shown on the left, a second jumper 150 is lifted by a third lifter 160 and a fourth lifter 170.

A first conventional means for lifting (gripping the shorts) is shown on right. The first jumper 110 is lifted by his shorts 112. The first lifter 120 lifts using both his left hand 121 and his right hand 122 on the bottom front of the shorts 112. The second lifter 130 is gripping the shorts with his left hand 131 and his right hand 132 (not shown) to lift. These grips allow the first lifter 120 and second lifter 130 to lift first jumper 110 to a height where he can intercept the ball 140.

A second conventional means for lift (gripping the thigh) is shown on the left. The fourth lifter 170 is using a similar technique of lifting as the second lifter 130 and uses both his right hand 171 and his left hand 172. Third lifter 160 is lifting second jumper 150 by his thigh 154. Note that the second jumper 150 is unstable, is falling, and was unable to intercept the ball because of the bad lift.

Lifting by the shorts has many disadvantages including, for example, discomfort for the jumper, less than optimal lift performance, and difficult to obtain grip. It is also difficult to obtain a secure grip on a bare thigh (e.g. third lifter 160).

FIG. 1B

Figure 1B:
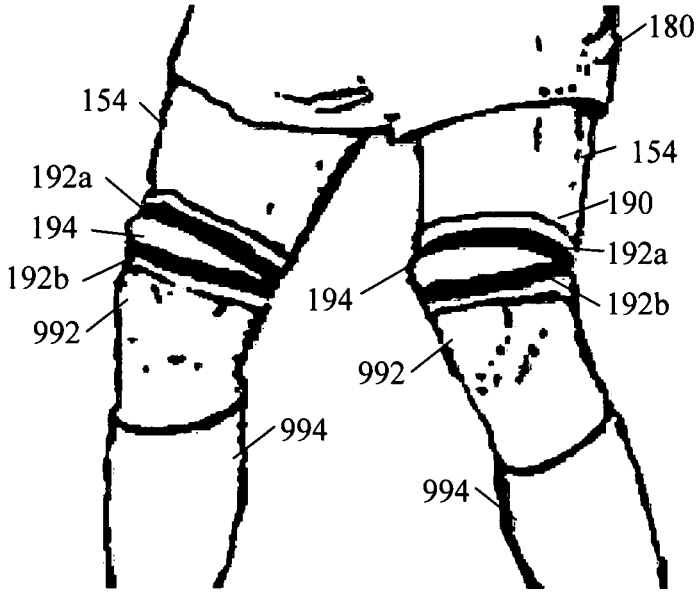

FIG. 1B illustrates a third jumper 180 with material wrapped around his thighs 154, just above each knee 992. The one-time-use material consists of an underwrap 190 covered by an upper strip of tape 192*a* and a lower strip of tape 192*b*. The underwrap 190 may consist of fabric athletic tape, foam tape, or cloth. Typically the tape is black, plastic, electrical tape. This arrangement creates a bulge 194. The bulge 194 may include additional layers of the underwrap 190 material.

The one-time-use thigh wrap also has many disadvantages including, for example, difficulty in applying consistently, requiring application by coach, trainer, or other player during the critical pre-game preparation time, discomfort, waste of materials, and debris often left behind.

FIG. 2

Figure 2:
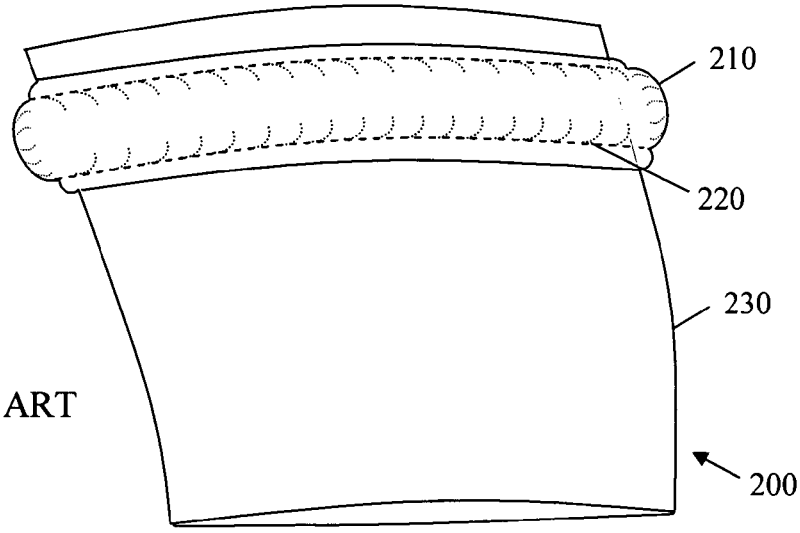
PRIOR ART Fig 2
FIG. 2 illustrates a prior art leg sleeve with grip.

FIG. 2 illustrates a leg sleeve 200 as previous disclosed in my U.S. patent application Ser. No. 11/499,023, filed Aug. 3, 2006. The leg sleeve 200 comprises a grip 210 attached to a sleeve material 230 with an attachment 220. The sleeve material 230 is a flexible, elastic, durable material such as neoprene or stretch fabric.

While such elastic leg sleeves have been used successfully, leg sleeves made of elastic material have several disadvantages discussed above, including more expensive materials, difficulty in manufacturing, and stretching and sliding up the jumpers leg during the lift. This uncontrolled sliding results in less stable, lower performance lift.

Figure 3A:
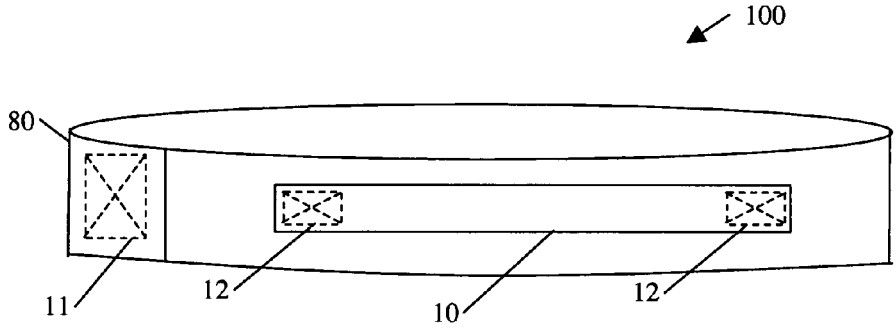
FIG. 3A through FIG. 3D illustrate various details and embodiments of the leg strap with horizontal handles.

FIG. 3A T*hrough* 3C

Figure 3B:
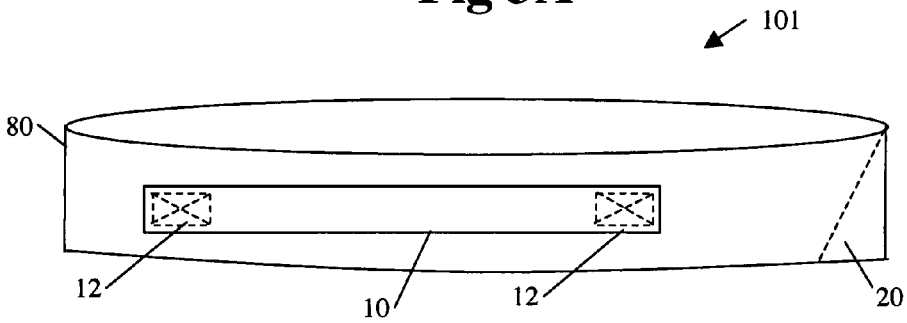
Figure 3C:
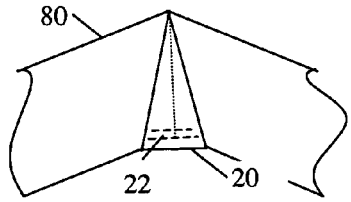

FIG. 3A through 3C show a leg strap with horizontal handles 100.

FIG. 3A shows an embodiment of leg strap 100 comprises a non-elastic strap 80 sufficient width to be comfortable to the jumper while be being lifted, for example, 1.5 to 2 inched wide man-made webbing. In this embodiment, the strap 80 is permanently attached with a strap attachment 11 giving it a predetermined size. For example, the predetermined sizes for small, medium, and large have a minimum circumference of 18, 20, or 22 inches, respectively. Attached to the strap 80 are preferably two horizontal handles 10 attached with handle attachments 12 at both ends, respectively. In the currently preferred embodiment, the handles 10 are made of elastic band material as discussed further in reference to FIG. 3D.

Alternatively, the handles 10 could be made of a smaller width strap material. Also, a single strap or band could be attached at four points around the circumference forming an equivalent set of handles 10

FIG. 3B shows a diagonal hem at a point in the strap 80 forming a dart 20. This dart 20 is used to forming a taper in the leg strap 100 providing a better fit to the contour of the thigh and preventing sliding up during lifting.

FIG. 3C shows a side view of the dart 20 being tacked down with a dart attachment. This prevents the sharp point of the dart from irritating other players.

FIG. 3D

Figure 3D:
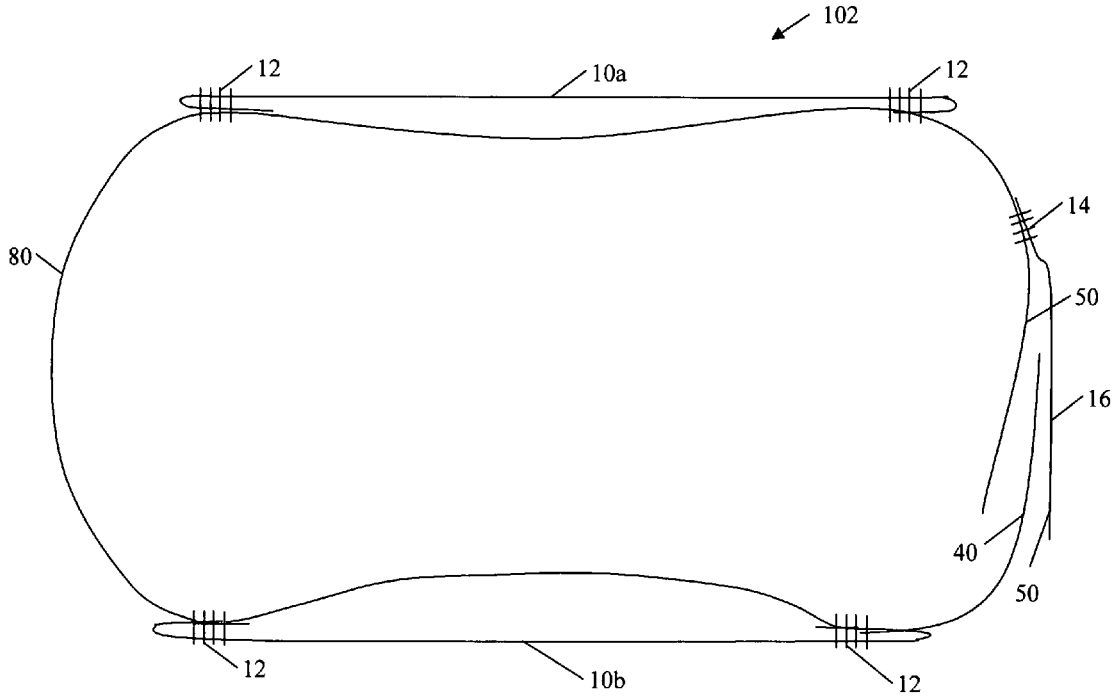

FIG. 3D shows a top, cross sectional view of an embodiment of leg strap with horizontal handle 100. This embodiment has a horizontal handle 10*a* on one side and horizontal handle 10*b* on the opposite side. This arrangement allows for one lifter to grip both sides of the leg of a jumper or can be used by two lifters at once. The handles 10 (*a*-*b*) are shown shorter in length than the corresponding section of the strap 80 between the handle attachments 12. This provides the advantageous features of a) a tighter, somewhat elastic fit when placed on the legs and b) more difficulty for an opposing to grasp the handles 10 while the wearer is running. On the other hand, the lifters (120 and 130) are able to grasp the handles 10 while the jumper is jumping or preparing to jump.

FIG. 3D also is used to illustrate an alternate, adjustable embodiment which instead of a permanent strap attachment 11, uses hook and loop fasteners comprising attachment hooks 50 which temporarily connect to the attachment loops 40. One end of the strap has attachment loops 40 and the other end of the strap has attachment hooks 50.

The embodiment show also uses a second strap 16, attached by the second strap attachment 14. The Y-shaped end with the two straps 80 and 16 have attachment hooks 950 which receive the other adjustable free end of strap 80 and attach temporarily to attachment loops 940 on both sides of the free end. Embodiments with this adjustable arrangement can be sold as "one size fits all."

FIG. 4

Figure 4:
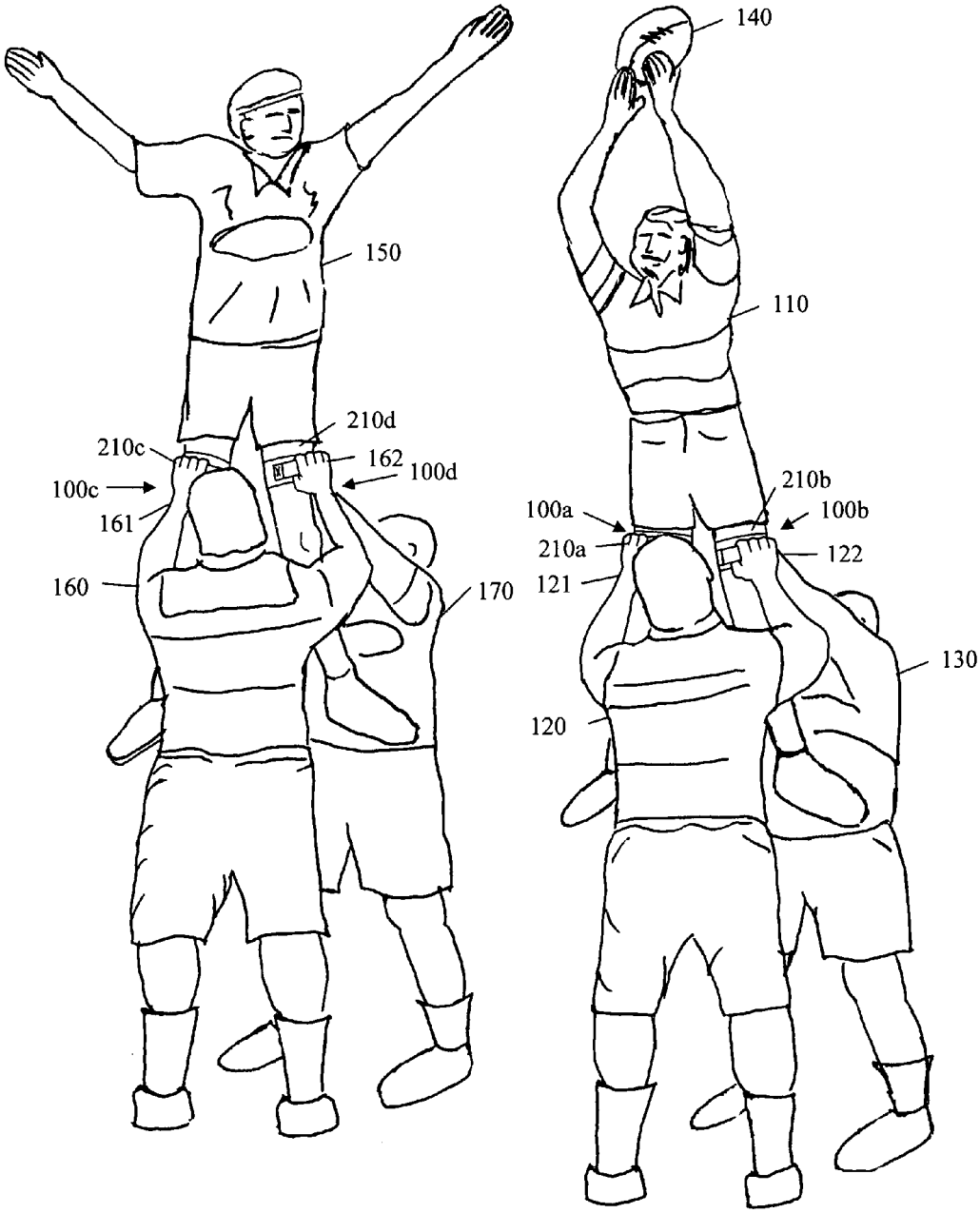
FIG. 4 shows the use of the leg strap with horizontal handles.

FIG. 4 shows the improved leg strap with horizontal handles 100, being used to assist in jumping and lifting for the lineout.

Prior to entering the game, each potential jumper (e.g. first jumper 110 and second jumper 150) applies one or more leg straps 100 of the present invention to one or more legs. When an opportunity to intercept the ball occurs, each jumper jumps. One or more players from the jumper's team are then able to grip the leg straps 100. For example, as shown in FIG. 4, the first jumper 110 jumps during a lineout. The first lifter 120 places his hands (121 and 122) on the back of each leg straps 100*a* and 100*b*, respectively. The second lifter 130 places his hands (131 and 132) on the front of each leg straps 100*a* and 100*b*, respectively. Together, the first lifter 120 and the second lifter 130 are able to: a) lift the first jumper 110 higher, b) sustain the first jumper 110 at the height of the jump until the first jumper 110 is able to intercept the ball 140, and c) lower the first jumper 110 safely to the ground. Likewise, the third lifter 160 and the fourth lifter 170 are able to secure lift, sustain, and lower the second jumper 150 (shown wearing leg straps 100*c* and 100*d*, respectively), who is able to have a more competitive and safe attempt at the ball 140.

Because the respective lifters can obtain a safe and secure grip on leg straps 100 of their respective jumper, both jumpers are able to: a) achieve a higher performance jump, b) be held stable during the jump, c) have a more consistent, more competitive attempt for the ball 140. The lifters are able to get a more consistent grip on the jumper. The jumper is able to jump with and be supported with less discomfort and more safety and confidence.

Compare the height and stability of the jumpers in FIG. 1A to FIG. 4 to see the increase in performance that may result from use of the present invention.

The increased safety and performance of the present invention may allow for changes in the Laws (rules) of Rugby to allow lifters to support jumpers using the various embodiments.

Further, while the leg straps 100 of the present invention are shown as applied to Rugby, the present invention, could be used in other sports that also require jumping, such as Volleyball (e.g. while spiking a set ball, etc.) or Baseball (while jumping at the fence to stop a home run, etc.).

Other Uses

While the descriptions of the various embodiments have been made in reference to Rugby Union, the present invention could also be used for other sports which involve, or in the future may involve, lifting, such as Volleyball, International Rules Football, Australian Rules Football, baseball, ice skating, dance, or other sports.

ADVANTAGES

Comfortable

The leg straps of the present invention offer comfort to the jumping player. The leg straps do not apply pressure to the sensitive crotch areas of the body, as conventional methods of lifting do. The wearer also does not risk pulling out the hairs of the leg during removal, as in certain conventional methods.

Effective

The leg straps of the present invention are effective. A lifter has much better odds for obtaining and maintaining a sure grip with the present invention than with conventional methods. Thus, the jumper is more consistently able to obtain an optimum jump.

Safe

Because of the effectiveness of the present invention in allowing lifters to have a sure grip, the present invention offers greater safety and lessens risk of injury to both jumping and lifting players, and even opponents Simple The present invention is simple to make and use. The present invention requires little time to put on.

Easy to Use

The present invention is easy to use. To install, the potential jumper simply applies, or pulls over, one leg device over each leg. The lifters easily can find a grip while lifting the jumper.

Unlike conventional methods of lifting, which require a second party such as a trainer or coach to apply and runs the risk of inconsistency, the present invention is easily put on by one person and gives consistent results.

Reusable

The present invention can be used over and over again. The conventional method of wraps and tapes can only be used once and a new one must be used for every game.

Because the conventional wraps and tapes can only be used once, the materials become trash after use. The remains of the wraps and tape are often strewn on the field and leave an unsightly, unprofessional appearance requiring extra effort to clean up.

Higher Performance

The present invention offers higher performance in jumping than conventional methods. The quality of grip maintained allows stronger and higher lift, for example during a Rugby lineout. Use of the present invention gives teams more options on plays to be run during the lineout. The use of the present invention does not hinder agility or running, as conventional taping sometimes does.

Quick

The present invention can be quickly applied and removed. Time from warm-up and pre-game training need not be taken to apply the leg devices. The conventional method of taping can take several minutes to apply and removal can also be a slow process. Conventional taping often requires assistance from a coach or other highly skilled person and detracts from the critical pre-game preparation.

Adjustable

One embodiment of the present invention can easily be adjusted for different players and thus are easily switched from player to player to accommodate substitutions.

Efficient

The conventional method of taping is wasteful. Trash is created after every game, and more taping and wrap materials need to be replaced and bought, adding to expenses. The present invention requires little or no trash.

Better Appearance

Conventional methods of lifting worsen the look of players. The present invention has a smooth, professional look. While conventional taping has limited options, the present invention can easily be manufactured in a variety of colors to match the team color or the individual preference of the wearer. Space on the device material may also be used to bear a team logo, national insignia, or advertising.

Can be Used with Compression Shorts

Cost Effective

Because the leg straps can be made relatively inexpensively, are reusable, and reduce waste, the present invention is cost effective. In particular, the leg strap with horizontal handles can be made very inexpensively, providing a larger market and encouraging less waste.

Conclusion, Ramification, and Scope

Accordingly, the present invention provides an easy to use, simple, safe, comfortable, reusable, and effective means for lifting a jumper.

While the above descriptions contain several specifics these should not be construed as limitations on the scope of the invention, but rather as examples of some of the preferred embodiments thereof. Many other variations are possible. For example, different widths of strap could be used. Additionally, the leg devices could be made of different materials or have additional features, or be used in different sports, without departing from the scope and spirit of the novel features of the present invention.

Accordingly, the scope of the invention should be determined not by the illustrated embodiments, but by the appended claims and their legal equivalents.

I claim:

1. A leg strap to be worn on a leg of a Rugby jumper for lifting the jumper by one or more lifters when engaged in a Rugby activity, comprising:

a non-elastic strap, independent of any other article of clothing, and having a predetermined length which is sized to tightly encircle a lower portion of a thigh of the jumper above a knee of the jumper; and at least one elastic handle having two ends, each end permanently affixed to a portion of the strap in a horizontal orientation along its length thereby allowing insertion of a hand between the handle and the strap to apply a lifting force to the jumper;

wherein the non-elastic strap is permanently formed in a loop with a strap attachment having sufficient strength to securely transfer the lifting force to the leg of the jumper, wherein the strap attachment is flat and flexible whereby the strap is comfortable for the jumper and safe for other players, wherein the non-elastic strap further comprises a dart, the dart forming the strap into a tapered shape, wherein the dart is held down in a flattened position by a dart attachment, wherein the strap has the tapered shape such that the strap matches the contour of the thigh of the jumper.

2. The leg strap of claim 1, wherein the length of the strap has a predetermined size.

3. The leg strap of claim 2, wherein the predetermined size is one of small, medium or large.

4. The leg strap of claim 2, wherein the predetermined size includes a length of 18 inches, 20 inches, or 22 inches.

5. The leg strap of claim 1, wherein the handle is comprised of an elastic band which is elastic to a predetermined stretch limit, whereby the elastic band stretches a sufficient amount to allow the insertion of a hand and becomes inelastic when the predetermined stretch limit is reached in order to hold the jumper securely.

6. The leg strap of claim 1, wherein the length of the handle is less than a length of the portion of the strap to which the handle is affixed, wherein in use on the thigh of the jumper, the handle is stretched taut and flattened against the strap.

7. The leg strap of claim 1, wherein each end of the handle is doubled under and attached to the strap with the handle attachment.

8. A leg strap to be worn on a leg of a Rugby jumper for lifting the jumper by one or more lifters when engaged in a Rugby activity, comprising:

a non-elastic strap, independent of any other article of clothing, and having a predetermined length which is sized to tightly encircle an upper portion of the leg of the jumper; and at least one elastic handle having two ends, each end permanently affixed to a portion of the strap in a horizontal orientation along its length thereby allowing insertion of a hand between the handle and the strap to apply a lifting force to the jumper;

wherein the non-elastic strap is permanently formed in a loop with a strap attachment having sufficient strength to securely transfer the lifting force to the leg of the jumper, wherein the non-elastic strap further comprises a dart, the dart forming the strap into a tapered shape, wherein the dart is held down in a flattened position by a dart attachment, wherein the strap has the tapered shape such that the strap matches the contour of the upper portion of the leg of the jumper, wherein the strap attachment and the dart attachment are flat and flexible whereby the strap is comfortable for the jumper and safe for other players.

9. The leg strap of claim 8, wherein the length of the strap has a predetermined size.

10. The leg strap of claim 9, wherein the predetermined size is one of small, medium or large.

11. The leg strap of claim 9, wherein the predetermined size includes a length of 18 inches, 20 inches, or 22 inches.

12. The leg strap of claim 8, wherein the handle is comprised of an elastic band which is elastic to a predetermined stretch limit, whereby the elastic band stretches a sufficient amount to allow the insertion of a hand and becomes inelastic when the predetermined stretch limit is reached in order to hold the jumper securely.

13. The leg strap of claim 8, wherein the length of the handle is less than a length of the portion of the strap to which the handle is affixed, wherein in use on the leg of the jumper, the handle is stretched taut and flattened against the strap.

14. A method for supporting a Rugby jumper by one or more lifters when engaged in a Rugby activity, comprising the steps of:

a) applying at least one leg strap according to claim 1 to a leg of the jumper;

b) the jumper jumping to a first position;

c) the one or more lifters inserting a hand between the handle and the strap to apply a lifting force to the jumper;

d) lifting the jumper to a second position higher than the first position;

e) holding the jumper in the second position for a period of time;

f) lowering the jumper; and g) repeating steps b) through f) as necessary.

15. The method of claim 14, wherein in the applying step a first leg strap is applied to the first leg of the jumper and a second leg strap is applied to a second leg of the jumper, and wherein in the inserting step the hand of a first lifter is inserted into the handle of the first leg strap and a hand of a second lifter is inserted into the handle of the second leg strap, whereby the jumper is lifted and held higher by the first lifter and the second lifter.

16. A method for supporting a Rugby jumper by one or more lifters when engaged in a Rugby activity, comprising the steps of:

a) applying at least one leg strap according to claim 8 to a leg of the jumper;

b) the jumper jumping to a first position;

c) the one or more lifters inserting a hand between the handle and the strap to apply a lifting force to the jumper;

d) lifting the jumper to a second position higher than the first position;

e) holding the jumper in the second position for a period of time;

f) lowering the jumper; and g) repeating steps b) through f) as necessary.

17. The method of claim 16, wherein in the applying step a first leg strap is applied to the first leg of the jumper and a second leg strap is applied to a second leg of the jumper, and wherein in the inserting step the hand of a first lifter is inserted into the handle of the first leg strap and a hand of a second lifter is inserted into the handle of the second leg strap, whereby the jumper is lifted and held higher by the first lifter and the second lifter.

* * * * *